United States Patent [19]

Bergman

[11] 4,362,311

[45] Dec. 7, 1982

[54] DISMOUNTABLE WHEEL-CHAIR

[76] Inventor: Per G. Bergman, Hyggevägen 21, Spånga, Sweden, S-163 54

[21] Appl. No.: 94,746

[22] Filed: Nov. 15, 1979

[30] Foreign Application Priority Data

Nov. 16, 1978 [SE] Sweden ..... 7811853

[51] Int. Cl.[3] ..... A61G 5/02

[52] U.S. Cl. ..... 280/242 WC; 297/440; 297/DIG. 4

[58] Field of Search ..... 280/242 WC, 47.18, 47.25, 280/30, 47.32; 297/130, 440, 442, 443, DIG. 4; 180/DIG. 3

[56] References Cited

U.S. PATENT DOCUMENTS

| | | | |
|---|---|---|---|
| 2,575,221 | 11/1951 | Horner et al. | 297/443 |
| 3,032,375 | 5/1962 | Lalandre | 297/440 |
| 3,216,738 | 11/1965 | Bockus | 297/DIG. 4 |
| 3,749,192 | 7/1973 | Karchak | 297/DIG. 4 |
| 3,865,434 | 2/1975 | Sully | 297/DIG. 4 |
| 3,896,891 | 7/1975 | Miltenburg | 180/DIG. 3 |

FOREIGN PATENT DOCUMENTS

| | | | |
|---|---|---|---|
| 2731952 | 1/1978 | Fed. Rep. of Germany | 280/242 WC |
| 2751966 | 5/1978 | Fed. Rep. of Germany | 297/DIG. 4 |
| 987157 | 3/1965 | United Kingdom | 280/242 WC |

*Primary Examiner*—John A. Pekar

*Attorney, Agent, or Firm*—Holman & Stern

[57] ABSTRACT

A dismountable wheel-chair including a base structure with connected wheels, seat with related back rest, and arm rests, the base structure being joined with one or a number of said parts of the wheel-chair by means of dismountable self-locking wedge joints having a vertical wedge axis. The wheel-chair can in a minimum of time be dismounted and stowed away on transfer to another means of transport, and requires thereby a minimum of space. The seat and the wheels can be exchanged to suit existing requirements. The wedge joints for a wheel can be arranged with downwardly extending wedges having attachment holes at different levels for axles of wheels with different diameters.

18 Claims, 10 Drawing Figures

5
6
4
23
22
14
28
1
22
14
28
15
21
3
21
31
2
8
Y
Y
7
12
13
X
2
8
Y
Y
11
13
X 32
5
6
23
2
4
15
22
z
14
1
12
21
2'
11
3
13
z
3'

2
7
3
8
14
15
22
1
14
22
3
2
7

Fig. 5
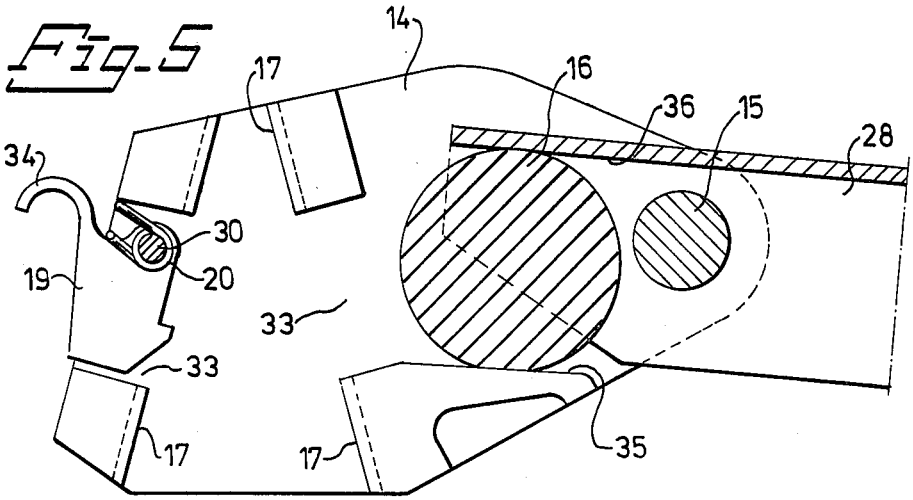
Fig. 7
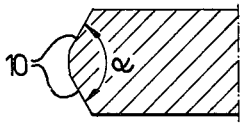
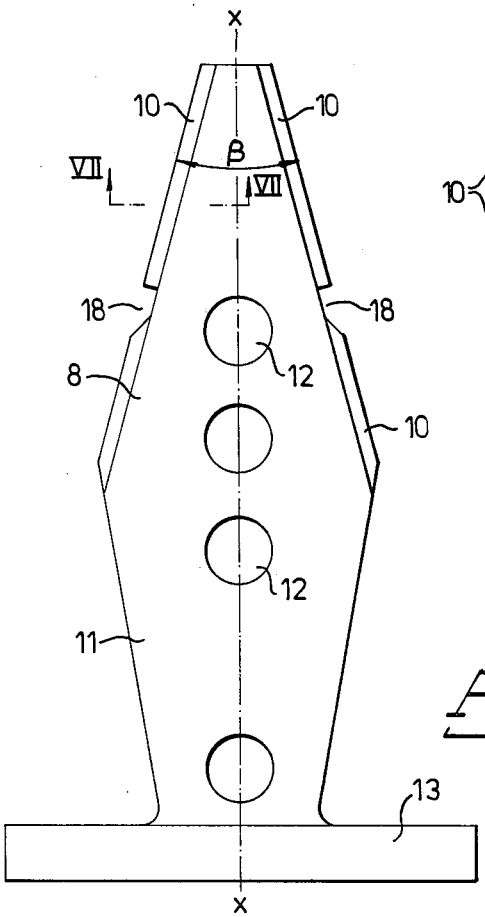
Fig. 6

DISMOUNTABLE WHEEL-CHAIR

BRIEF SUMMARY OF THE INVENTION

The present invention relates to a dismountable wheel-chair for disabled persons, including a base structure and to the base structure connected wheels, seat with associated back rest, and arm rests.

Wheel-chairs of the above type are normally moved manually, whereby the disabled person to a large extent can transport himself by applying a force to drive wheels located on each side of the wheelchair by means of arms and hands. At a certain distance in the direction of travel, the wheel-chair is supported by two caster wheels, arranged at each side of same. The last mentioned wheels, which are normally smaller than the drive wheels, are supported in a fork and rotatable around a vertical axis.

Previously known wheel-chairs are more or less suitable for the intended purpose as a means of transport for the disabled person, in the following referred to as the patient. Problems arise, especially when the patient is forced to move to another means of transport, for example train or car, when it is usually desirable to bring the wheel-chair. For this purpose, and in order to simplify the transport of the wheel-chair, wheel-chairs have been arranged dismountable or foldable.

A disadvantage with previously known types of dismountable wheel-chairs is that the separated parts are relatively large and the design is complicated, whereby dismounting and assembly of the wheel-chair parts is difficult. On the other hand, foldable wheel-chairs are complicated and even when folded together, relatively heavy and large.

A basic concept that must relate to a wheel-chair, is that the chair should offer the patient a correct sitting position. Particular attention must therefore be paid to the seat of the chair and associated back rest and arm rests. The design of these parts may be needed to be modified from case to case, depending on the condition of the patient. Consequently, said parts of the wheel-chair should be exchangeable so that one and the same wheel-chair can easily be adjusted to different patients and purposes, and easily be arranged with different and exchangeable seats. Foldable wheel-chairs are in this respect extremely unsatisfactory, since the supporting parts for the patient are normally related to the design and not intended to meet the ergonomic claims of today. In this connection, the seats and back rests used of stretched foldable textile material are often completely unsuitable. The object of the present invention is to disclose a wheel-chair comprising a small number of simple parts, which independently easily can be dismounted from remaining parts, and thereafter assembled again, and which after dismounting can be stowed away in a minimum of space, each separate part and all the parts together having a low weight and being easy to clean.

The dismountable wheel-chair of the above type according to the present invention is characterised in that the base structure is dismountably joined with one or a number of connecting parts by means of dismountable self-locking wedge joints having a mainly vertical wedge axis.

According to a preferred embodiment, the drive wheels are attached to upwardly converging wedges insertable into wedge housings connected to the base structure and with non-rotatable guidance of the wedge, whereby correct alignment of the axle for the drive wheel is ensured. The converging sides of the wedges are preferably arranged with a profile similar to a roof ridge, each side being restricted by two contact surfaces inclined with respect to each other.

By arranging a number of connection holes in vertical space relationship for the axle of the drive wheel in the downwardly extended wedge, the same wedge can be utilized for drive wheels having different radii while maintaining the same height position for the wheel-chair.

In order to achieve suspension for the drive wheels, the wedge housing is preferably pivotably attached to the base structure, pivotable against the reaction of a spring. Said spring could for example be a rubber element.

Extremely good contact between wedge and wedge housing can be achieved by interrupting the side surfaces of the wedge by means of a recess. Said recess can advantageously co-act with a locking means arranged in the wedge housing. The locking means is manually released when dismounting, possibly utilizing a common release mechanism for both attachment wedges for the drive wheels.

The link wheels are normally supported in forks being rotatable around a vertical axis in a bearing housing attached to the base structure. According to a preferred embodiment, the spindle bearing is arranged in a vertical conical wedge insertable into a wedge housing having a conical inside surface and being connected to the base structure. In assembled position, the wedge is locked and it can be released when dismounting.

The wedge joints for connection of the seat with associated back rest to the base structure are preferably arranged in such a way, that the seat can be turned 180°. The wedge housing attached to the seat can be arranged as double wedge housing, whereby also insertion of wedges extending from the arm rests is faciliated.

Embodiments of the present invention are more fully described below, reference being made to the accompanying drawings.

BRIEF DESCRIPTION OF THE SEVERAL VIEWS OF THE DRAWING

FIG. 5 shows the pivotable connection of a wedge housing to the base structure, in an enlarged scale.

FIG. 6 shows in a similar scale the co-acting wedge arranged for connection of a drive wheel.

FIG. 7 is a fragmentary cross-sectional view along line VII—VII in FIG. 6.

DETAILED DESCRIPTION

Figure 1:
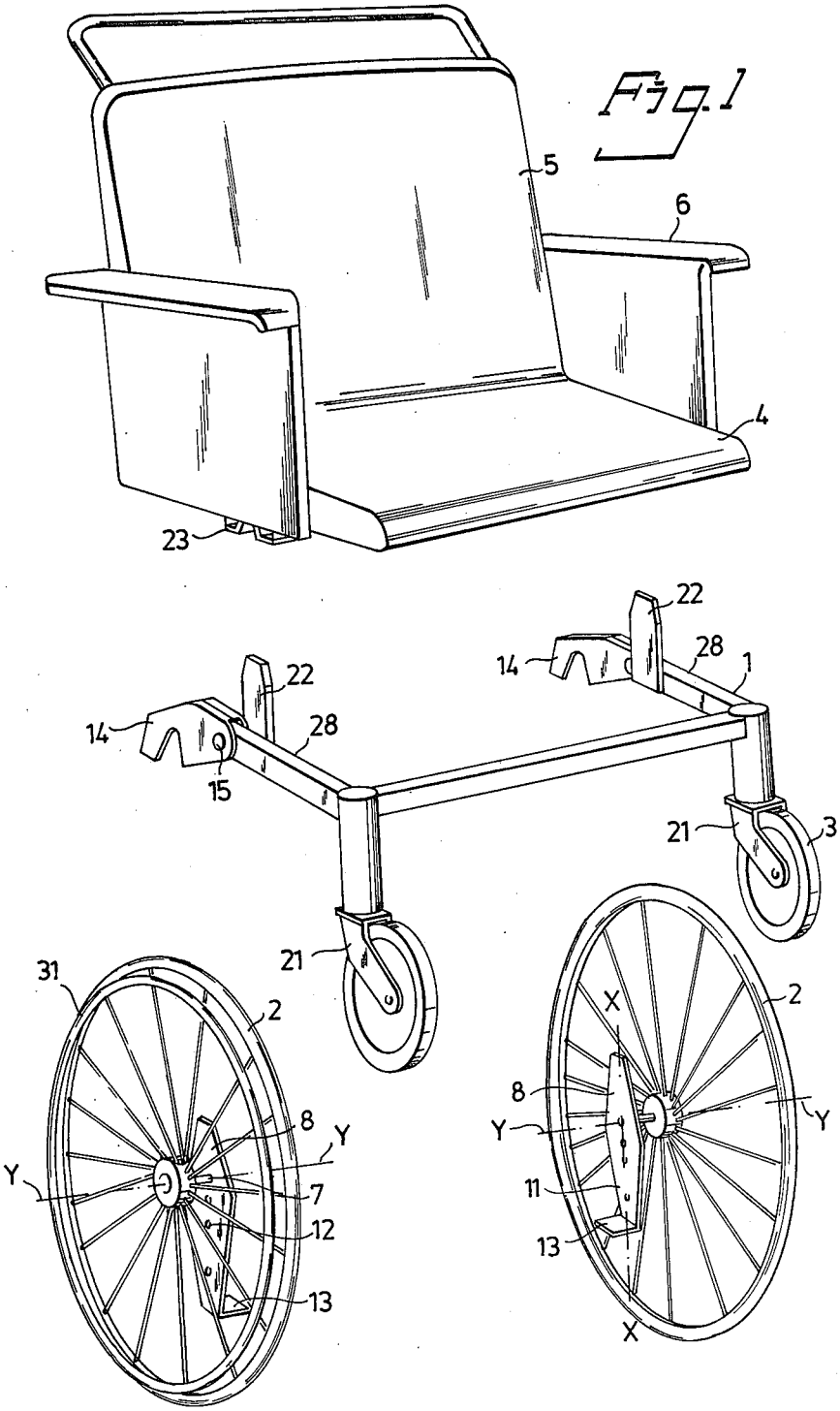
FIG. 1 shows a schematic exploded view in perspective of a wheel-chair according to the invention.

The wheel-chair shown in FIG. 1 has a seat 4 with a connected back rest 5. Two separate arm rests can be connected to the seat 4 as more fully described below.

The wheel-chair is held together by means of a base structure 1. It is in the shown embodiment arranged as a U-shaped part, e.g. manufactured from a tubular section, to which remaining parts of the wheel-chair are connected. The connection of said parts to the base structure is accomplished by means of wedge joints, as more fully described below, arranged to faciliate simple dismounting of the joints, whereby the parts of the wheel-chair can be separated from each other.

According to FIG. 1, the base structure is U-shaped, but the base structure can also have a different shape, provided that the base structure forms a frame with suitably located supporting points for the wheels and the seat of the wheel-chair. Normally, the wheel-chair is supported by four wheels, two drive wheels 2 and two caster wheels 3. The drive wheels are located on each side of the base structure adjacent to the end portions of the legs of the U-shaped section. Each wheel is independently rotatably arranged on an axle 7. Said axle can be attached to a hole 12 in a wedge 8, said wedge being shown in FIG. 6. The wedge 8 is arranged with its long axis x—x mainly vertical and is symmetric in relation to said axis. The upwardly converging sides of the wedge are restricted by contact surfaces 10 forming an angle $\alpha$ in relation to each other (FIG. 7). The angle $\alpha$ can have a value between 30° and 170°, whereas the angle $\beta$ between the converging side surfaces of the wedge can have a value between 10° and 90°. The wedge is arranged insertable into a wedge housing 14 (FIG. 5) connected to the base structure and having correspondingly arranged contact surfaces 17.

Figure 2:
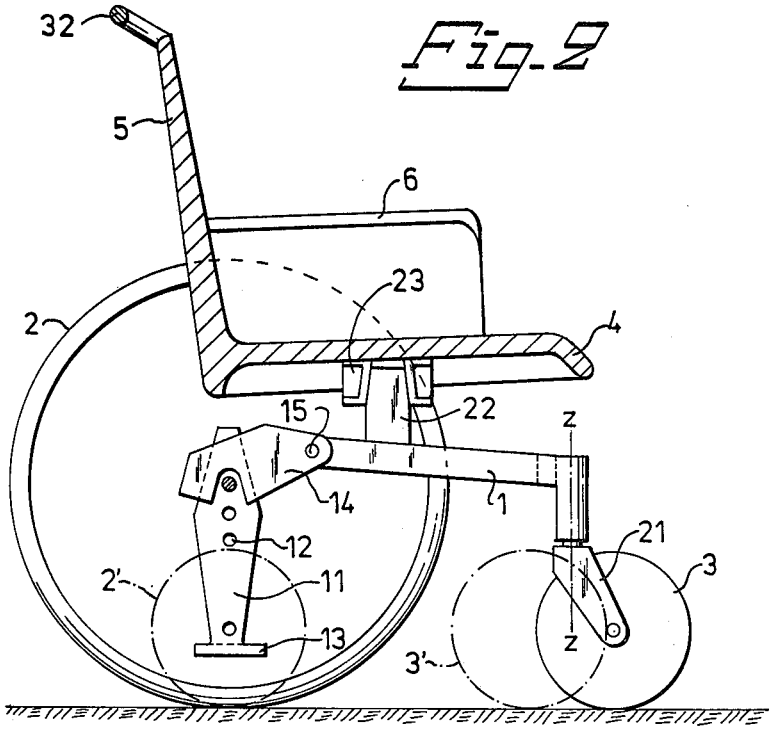
FIG. 2 shows a side elevation of the wheel-chair, partly in cross-section.
Figure 3:
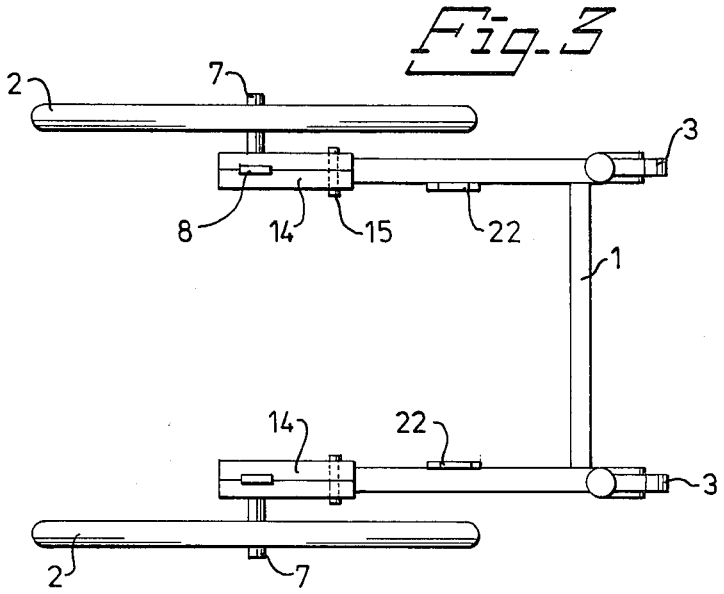
FIG. 3 is a top plan view of the wheel-chair shown in FIG. 2 with the seat removed.

It may be desired to utilize drive wheels with different diameters. For this purpose, the wedge 8 is arranged with a number of vertically spaced holes 12 for the axle of the wheel, and the height to said holes from the supporting surface for the wheel-chair corresponds to the radius of the drive wheel utilized. Accordingly, the seat 4 of the wheel chair will remain at an unchanged height above the supporting surface when wheels are changed. The axles 7 of the drive wheels can easily be attached to said holes 12, and locked in inserted position by means of a nut. FIG. 2 shows schematically a manually operated drive wheel 2 indicated with a continuous line, and a smaller wheel 2' is indicated with a broken line, if desired arranged to replace the larger wheel.

When the patient is moved with assistance from another person, said person grips for example a handle 32 located at the back rest, and pushes the wheel-chair forward. When passing an obstacle in the road surface, the caster wheels must be lifted. For this purpose, the downwardly extended part of the wedge 8 is arranged with a support plate 13, against which the transporting assistant applies a pressure force with either foot.

The above wedge 8 is insertable into a wedge housing 14. The housing is shown more in detail in FIG. 5, which shows the inside of the housing. The housing has contact surfaces 17 inclined with respect to each other corresponding to the contact surfaces 10 of the wedge 8. Since the co-acting contact surfaces 10, 17 of wedge and housing form an angle $\alpha$ in relation to each other, a firm and non-rotatable insertion of the wedge in the housing is obtained. The angle of inclination $\alpha$ of the contact surfaces in relation to each other along each side of the wedge can be varied with consideration paid to the material utilized for wedge and housing, and the grade of machining for the surfaces, for example in the region of 90°. The angle $\beta$ between the converging sides of the wedge is dependent on similar parameters and can for example be in the region of 30°. The angles $\alpha$ and $\beta$ are determined according to the above on basis of the fact that the wedge should be held firmly within the wedge housing and that also removal of the wedge from the housing should be effected without difficulties. In order to secure an even and firm contact between the surfaces 10 and 17, these surfaces do not extend along the total length of the wedge joint, but are interrupted in the central portions, whereby only the efficient end portions of said surfaces take up contact against each other. Said interruption is obtained by means of a recess 18 in the sides of the wedge and/or recesses 33 in the inside surfaces of the housing. In the recess 33 located at the free rear end portion of the housing 14, a locking member 19 is arranged to engage corresponding recess 18 in the wedge. The lock member 19 is pivotably arranged around a stud 30 and pressed inwardly against the wedge by means of a spring 20. The lock member can be released from locked position manually by a lever 34. The lock member 19 serves basically as a securing member for holding the wedge 8 within the housing 14 when the complete wheel-chair is lifted. During load and movement of the wheel-chair, the wedge is held firmly in unchanged inserted position within the housing.

To release the wedge from the housing, it is sufficient to release the lock member 19 and simultaneously lift the base structure 1 by means of the handle 34, whereby the base structure is automatically separated from the drive wheel assembly. By means of a device (not shown), it is alternatively possible to simultaneously influence both lock members for each drive wheel assembly, and thus simultaneously release both drive wheels from the base structure.

As shown in FIG. 6, the wedge 8 is arranged with a recess 18 on both sides, in order to faciliate rotation around its long axis, and thus faciliate connection to the right or left hand side of the base structure.

The connection of the wedge housing 14 to the base structure 1 is shown in more detail in FIG. 5. At the end portion of each leg 28 of the base structure, a pivoting stud 15 is attached, having an axis parallel in relation to the axis y—y of the drive wheel. The housing 14 is pivotably attached to said pivoting stud.

A suspending member, which is preferably a rubber element 16, is located between an inside wall portion 36 of the leg 28 of the base structure and a supporting surface 35 on the wedge housing 14. Said suspending member is located at the same side of the pivoting stud 15 as the wedge 8 inserted into the housing. When a load is applied, the housing 14 pivots clockwise according to FIG. 5 around the pivoting stud 15 whereby the suspending member 16 is compressed between wall 36 and surface 35. The drive wheels 2, 2' are thus suspended, which improves the comfort during transport.

Figure 10:
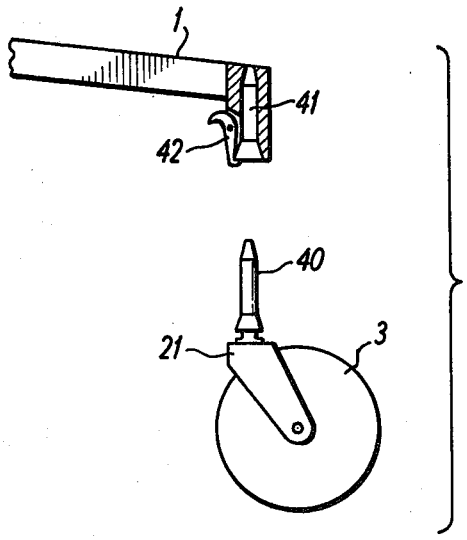
FIG. 10 shows a view in elevation and partly in cross-section of the details of the caster wheel, utilized in this invention.

The caster wheels 3, as shown in more detail in FIGS. 2 and 10, are in a conventional way supported in a fork 21 which is pivotable around a vertical axis z—z, and the horizontal wheel axis is offset from the vertical pivoting axis z—z. The fork 21 can be suspended in fixed bearings on the base structure 1 in a conventional way, but utilizing the invention, it is possible to further improve the wheel-chair by also making the caster wheels 3 dismountable from the base structure. For this purpose, the bearing for a pivoting movement around the vertical axis z—z may be a spindle (not shown) arranged on the base of an upwardly converging conical wedge 40 insertable into a wedge seat 41 attached to the base structure and having a corresponding conical surface. The conical wedge is in the inserted position secured by means of a manually releasable lock member 42. The conical angle is determined on basis of the facts previously mentioned with regard to the wedge 8, and the lock member is designed according to corresponding principles.

Figure 8:
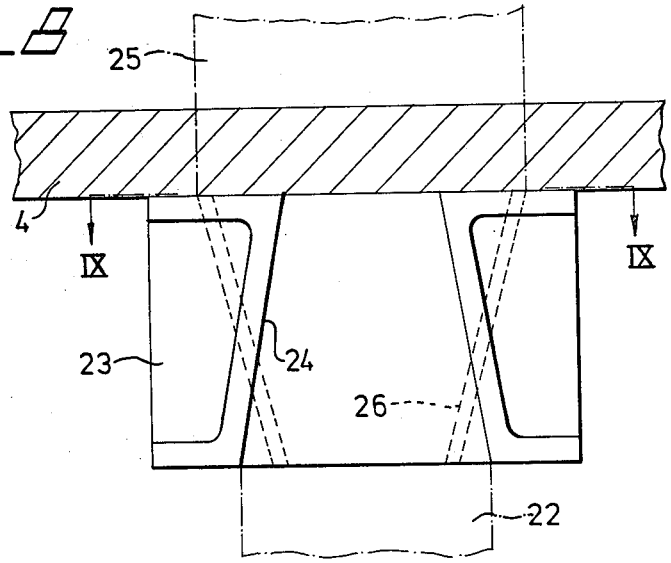
FIG. 8 shows the wedge housing for a wedge joint between the seat and an arm rest respectively, and the base structure.
Figure 9:
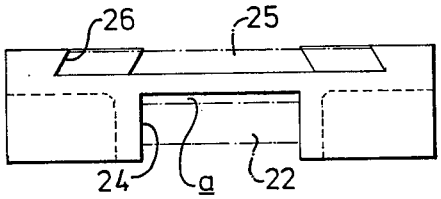
FIG. 9 shows said wedge housing as viewed along line IX—IX of FIG. 8.

At the central portion of each leg 28 of the base structure 1, an upwardly converging wedge 22 is attached, arranged insertable into wedge housings 23 attached to the seat 4. The wedges and the wedge housings are symmetrically located on each side of the base structure 1 and the seat 4 respectively, and in the longitudinal direction of the wheel-chair located in such a way, that a load applied from the seat as well as possible is balanced, having its vertical resultant basically in the centre of the wheel-chair wheel base. As shown in FIGS. 8 and 9, the wedges 22 are arranged with plane and upwardly converging contact surfaces, interacting with correspondingly located contact surfaces 24 in the wedge housings 23. Since there are no particular conditions in this case relating to non-rotatable insertion of the wedges 22 into the wedge housings 23, a more simple design of the contact surfaces can be used. As shown in FIG. 9, a certain play a sideways is allowed between the wedge 22 and the bottom of the wedge seat which is open on the side in the wedge housing 23, since said play has no functional importance, but on the other hand ease the fitting of the seat on the base structure. The wedges 22 converge symmetrically upwards around the length axis at an angle decided on basis of the facts given with regard to the wedges 8. A locking member, arranged to secure the wedges in inserted position, can also be arranged. The symmetrical location of the wedge joints 22, 23 makes it possible to relocate the seat 4 and the back rest 5 extremely simply by means of horizontal rotation 180°, whereafter the seat is placed on the wedges 22 again.

The wedge housings 23 can advantageously be arranged for simultaneous insertion of the arm rests 6. Downwardly converging wedges 25 attached to the arm rests are in this case inserted into a recess 26 in the wedge housing 23, arranged as a double wedge housing, as shown in FIGS. 8 and 9. The recesses 26 can in this case for example be arranged with a trapezoidal cross-section. In said figures, the wedges 22 and 25 are indicated in inserted positions by means of broken lines.

Figure 4:
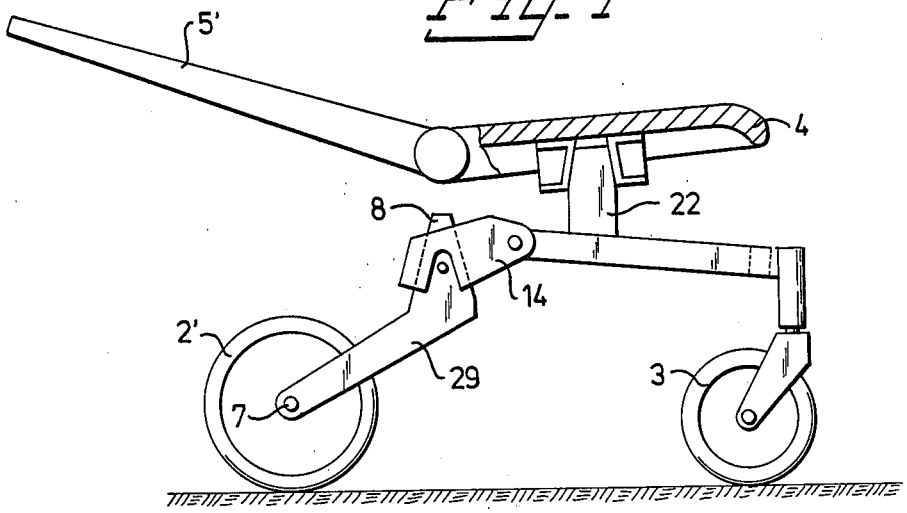
FIG. 4 shows a further embodiment of the wheel-chair according to the invention.

In certain cases, it is desirable to increase the wheel base of the wheel-chair. FIG. 4 shows an embodiment with prolonged back rest 5', which is folded down in a basically horizontal position for a patient in a basically lying position. In order to maintain the balance of the wheel-chair, the wedge 8 is arranged with a rearwardly directed extension 29, in this case having a wheel 2' arranged at the free end portion. Hereby, the wheel base of the wheel-chair is increased in direction backwards, in order to compensate for the movement of the load centre in that direction.

The element of the wedge joints according to the present invention, such as wedges and wedge housings, can advantageously be manufactured from pressure moulded light metal alloy or a suitable synthetic plastics material. The base structure is preferably manufactured from drawn tubular profiles of light metal alloy or steel.

I claim:

1. A dismountable wheel-chair comprising a base structure, rotatably mounted drive wheels and caster wheels, and a seat member with a back rest, means for detachably connecting said drive wheels, caster wheels and seat member to said base member, and means for detachably connecting said arm rests to said seat member, said means for detachably connecting said drive wheels, seat member and arm rests comprising separate self-locking wedge joints having substantially vertical wedge axes.

2. Wheel-chair according to claim 1, wherein said means for detachably connecting said drive wheels to said base member comprises an axle for each drive wheel, each said drive wheel being rotatably mounted, on said axle, an upwardly converging wedge, a wedge housing connected to each opposite side of said base structure, each said wedge and wedge housing having complementary engaging wedge surfaces, said wedge being insertable into said housing so that said complementary surfaces engage and guide said wedge into fixed position on said base structure, each said axle being attached horizontally to each said wedge so that said drive wheels are in fixed axial alignment.

3. Wheel-chair according to claim 2, wherein said complementary engaging surfaces are formed by two contact surfaces lying in converging planes having an internal angle between 30° and 170°, said contact surfaces being symmetrically disposed and converging outwardly with respect to the wedge axis.

4. Wheel-chair according to claim 2, wherein each said wedge has a vertical downwardly directed extension, and a plurality of vertically spaced holes for insertion of said axle for the drive wheel.

5. Wheel-chair according to claim 2, wherein each said wedge housing is pivotably connected to the base structure to facilitate a pivoting movement around an axis parallel to the axles of the drive wheels and resilient means is provided to impose a spring force against said pivoting movement.

6. Wheel-chair according to claim 5, wherein said resilient means comprises a compressible member disposed between the wedge housing and the base structure for compressible suspension of the load applied from the wheel-chair.

7. Wheel-chair according to claim 6, wherein said compressible member comprises a rubber element.

8. Wheel-chair according to claim 2, wherein each said wedge has an extension arm extending rearwardly and downwardly at an angle from the base structure with respect to the seat, and said drive wheel axle is attached to the outer end portion thereof.

9. Wheel-chair according to claim 2 or 3, wherein said wedge has a recess in each engaging surface, whereby said surface on each side of said wedge is divided.

10. Wheel-chair according to claim 9, and further comprising a spring-urged manually releasable lock member mounted on the wedge housing to engage in said recess to releasably retain said wedge in said wedge housing.

11. Wheel-chair according to claim 1, wherein each caster wheel is rotatably journaled in a fork member, said fork member being attached by a rotatable spindle to the base of a conical wedge, a conical wedge seat is provided on the base structure to receive said conical wedge and a manually releasable lock member is provided on said conical wedge seat to releasably retain said conical wedge in said seat.

12. Wheel-chair according to claim 1, wherein said detachable connections for said seat comprise upwardly converging seat wedges attached to said base structure, and wedge housings attached to the seat in cooperative relationship to said seat wedges to form wedge joints when assembled, said wedge joints for the seat being symmetrically located on each side of the base structure within the wheel base of the wheel-chair in a position such that the seat can be lifted and rotated in the horizontal plane 180° and thereafter attached for travel in the opposed direction with the same stability.

13. Wheel-chair according to claim 12, wherein said seat wedges comprise opposed converging sides and said wedge housings have complementary plane contact surfaces which engage said converging sides when assembled.

14. Wheel-chair according to claim 2 or 12, wherein said seat wedge housings are arranged as double wedge housings each comprising second plane contact surfaces converging downwardly, and downwardly converging wedges extending from the arm rests insertable into said housings in engagement with said second plane surfaces.

15. Wheel-chair according to claim 14, wherein said wedges extending from the arm rests have a trapezoidal cross-section.

16. Wheel-chair according to any one of claims 1, 2, 3, 4, 5, 6, 7, 8, 11, 12, 13, or 15, wherein the angle of convergence for said wedges is between 10° and 90°.

17. Wheel-chair according to claim 14, wherein the base structure comprises a U-shaped beam having rearwardly directed sides and opening, and the wedge housings for said drive wheel wedges are attached at the rear end portions of said sides of the beam and the wedges for the seat are attached to the side parts of said beam forward of said rear end portions.

18. Wheel-chair according to any one of claims 2, 3, 4, 5, 6, 7 or 8 wherein the base structure comprises a U-shaped beam having rearwardly directed sides and opening, and the wedge housings for said drive wheel wedges are attached at the rear end portions of said sides of the beam.

* * * * *